United States Patent [19]

Tsunoda et al.

[11] Patent Number: 4,729,293

[45] Date of Patent: Mar. 8, 1988

[54] AIR DIRECTION CONTROL APPARATUS FOR A LOUVER AT AN AIR OUTLET

[75] Inventors: Hideo Tsunoda, Numazu; Harunobu Nukushina, Fuji, both of Japan

[73] Assignee: Kabushiki Kaisha Toshiba, Kawasaki, Japan

[21] Appl. No.: 844,940

[22] Filed: Mar. 27, 1986

[30] Foreign Application Priority Data

Mar. 29, 1985 [JP] Japan ..... 60-45118[U]
Jul. 24, 1985 [JP] Japan ..... 60-162070

[51] Int. Cl.[4] ..... F24F 13/10
[52] U.S. Cl. ..... 98/40.24; 98/94.2
[58] Field of Search ..... 98/40.24, 40.26, 40.27, 98/94.2, 110, 121.2; 236/51; 318/16

[56] References Cited

U.S. PATENT DOCUMENTS 3,348,108 10/1967 D'Onofrio ..... 318/16
4,183,223 1/1980 Alsenz ..... 236/51 X
4,362,270 12/1982 Cleary et al. ..... 236/51 X
4,433,719 2/1984 Cherry et al. ..... 236/51 X

FOREIGN PATENT DOCUMENTS 56-122035 2/1980 Japan .

*Primary Examiner*—Harold Joyce
*Attorney, Agent, or Firm*—Cushman, Darby & Cushman

[57] ABSTRACT

An air direction control apparatus comprises a remote controller having an air direction change operation section and a transmitting section for transmitting a control signal intermittently after a drive instruction signal from the air direction change operation section has been detected, and an associated device responsive to the control signal to analyze its contents and, if there is a louver drive signal, drive a louver motor to permit the louver slats to be controlled so that the direction of air at an air inlet is changed.

2 Claims, 9 Drawing Figures

AIR DIRECTION CONTROL APPARATUS FOR A LOUVER AT AN AIR OUTLET

BACKGROUND OF THE INVENTION

This invention relates to an air direction control apparatus which permits the angle of louver slats at an air outlet of an air conditioner to be remotely controlled.

In general, an air conditioner has a louver equipped with a parallel array of swingable slats, at an air outlet of a body casing and, through the swing of these slats, it is possible to control an angle at which warm or cooling air is blown out through the parallel array of slats.

In this type of an air conditioner, a remote control operation is performed using an electromagnetic wave, ultrasonic wave, infrared ray, etc., in which case the parallel array of slats is swung during the continuous transmission of a control signal from a remote controller and stopped upon the interruption of such a control signal. In this connection it is to be noted that said control signal has a fixed frequency assigned for louver drive.

That is, during the period of a depression of a push button switch on the remote controller a control signal is delivered in a continuous fashion. During the period of the reception of the control signal the parallel array of slats can be continuously swung, on the air conditioner.

Upon the release of a push button switch on the remote controller the control signal is interrupted, stopping the driving operation of the louver and thus holding the parallel array of slats at that stopped position. In other words, the user can operate the louver while depressing the push button switch and stop the louver in a desired position upon the release of his finger off the push button switch.

In this system, however, the control signal has to be transmitted continuously during a time period from the ON to the OFF operation, presenting a problem of involving a greater dissipation power on the remote controller. In general, the remote controller is equipped with a dry cell and thus the power capacity is smaller. An increase in the power capacity involves a grave disadvantage of reducing a dry cell life and thus it finds no wider practical application.

SUMMARY OF THE INVENTION

It is accordingly the object of this invention to provide an air direction control apparatus for a louver at an air outlet, which can decrease a dissipation power on a remote controller and readily and safely control an angle at which air is blown off through a parallel array of slats of the louver.

According to this invention there is provided an air direction control apparatus for a louver at an air outlet, which can reduce a burden of a dry cell built into a remote controller so that the louver can be safely controlled for a longer period of time.

DESCRIPTION OF THE PREFERRED EMBODIMENTS

The embodiment of this invention will be explained below with reference to FIGS. 1 to 5.

Figure 1:
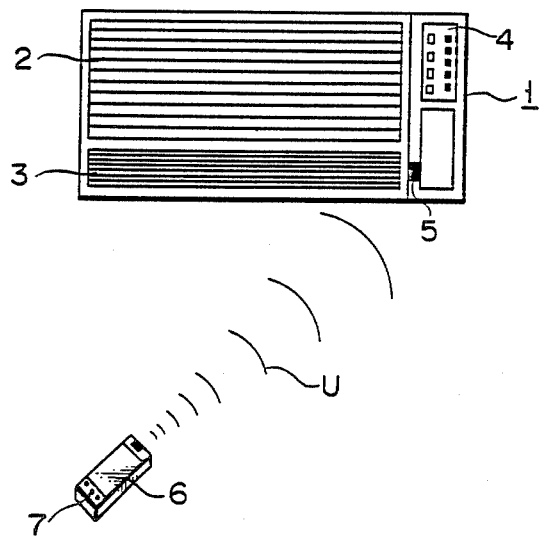
FIG. 1 shows an outer appearance of an air conditioner and remote controller as used in an embodiment of this invention.

FIG. 1 shows an outer appearance showing an air conditioner and remote controller. The remote controller is adapted to transmit, for example, an electromagnetic wave, ultrasonic wave or infrared ray as a control signal to the air conditioner to control the temperature and direction of the air, as well as the operation and stopping of the air conditioner.

The remote control operation, using an infrared ray, will be explained below in connection with the embodiment of this invention. Suction inlet 2, air outlet 3, display section 4, and light receiving section 5 for receiving the infrared ray as a control signal are disposed at the front portion of air conditioner 1. Light receiving section 5 receives the infrared ray, as a control signal, from remote controller 6. Remote controller 6 has push button switches 7 to select a desired control signal.

Figure 2:
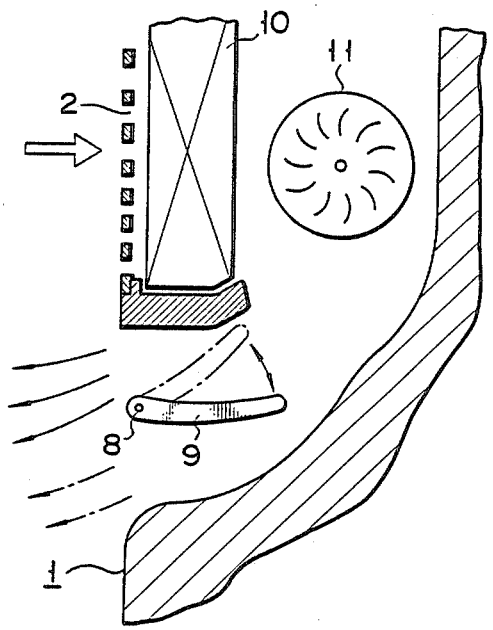
FIG. 2 is a cross-sectional view showing a louver as used in the embodiment of this invention.

As shown in FIG. 2, louver 9 is provided at air outlet 9 with the opposite ends of each louver slat mounted on corresponding shafts. The louver slat can be swung continuously in a range from a horizontal to a vertical position.

Where a plurality of slats, for example, a parallel array of slats are arranged for louver 9, they are coupled by a linkage which is in turn coupled to a motor to permit the louver slats to be swingably driven in a range from a horizontal to a vertical position.

Figure 3:
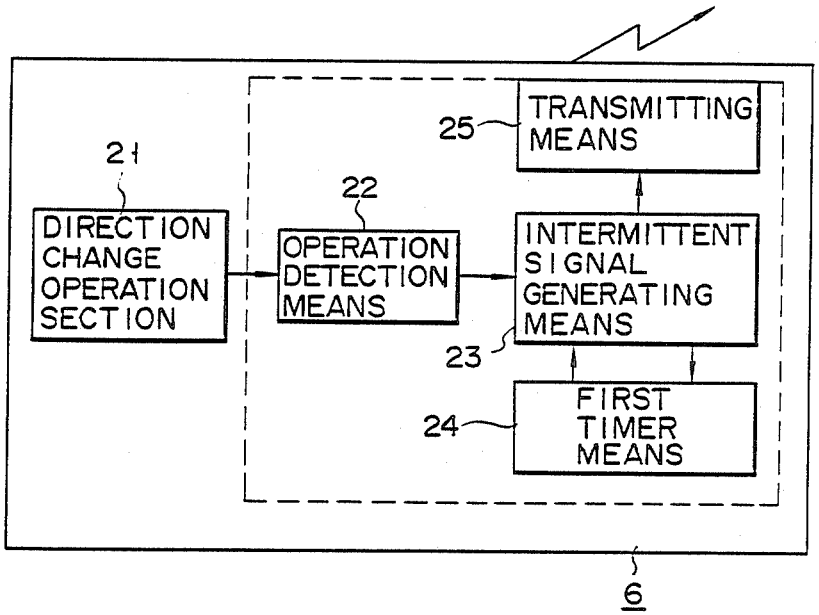
FIG. 3 is a block diagram showing an arrangement of the remote controller as used in the embodiment of this invention.

In FIG. 2 heat exchanger 10 is located on the side of suction inlet 2 to heat or cool air. This air is guided by blower 11 toward louver 9 where it is blown off in a desired direction. FIG. 3 is a block diagram showing on form of remote controller 6. If this push button switch of direction change operation section 21 is operated this signal is detected by operation detection means 22. The operation detection means sends a louver operation signal to intermittent signal generating means 23. Intermittent signal generating means 23 is controlled by first timer means 24. During a time period in which the louver drive signal is supplied to intermittent signal generating means 23, an intermittent signal is produced for each setting time t1 of first timer means 24 and it is sent to transmitting means 25 where a control signal is transmitted. It is to be noted that transmitting means 25 transmits an infrared ray as a signal.

Figure 4:
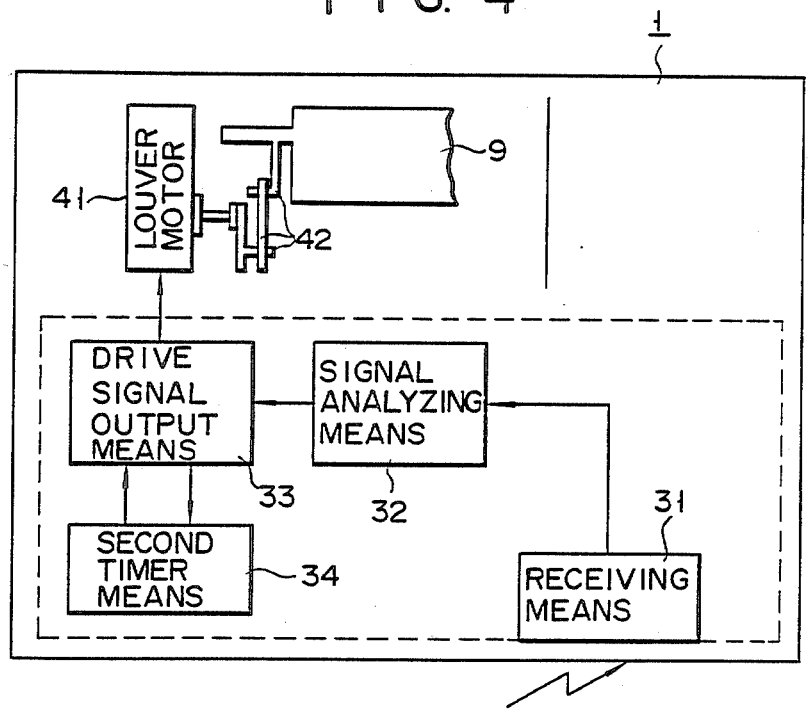
FIG. 4 is a block diagram of the air conditioner showing an associated section as used in the embodiment of this invention.

FIG. 4 is a block diagram showing a receiving section in air conditioner body 1, which receives a control signal. That is, receiving means 31 receives the control signal from transmitting means 25. The control signal, which has been received at receiving means 21, is analyzed by signal analyzing means 32. If the result of analysis is found to be a louver drive signal, it energizes drive signal output means 33. Drive signal output means 33 is controlled by second timer 34. Each time drive signal output means receives a louver drive instruction signal from signal analyzing means 32 it delivers a drive signal to louver motor 41 by a time interval corresponding to the setting time of second timer 34, causing the motor to be driven to permit the parallel array of louver slats to be swingably driven through linkage 42.

Figures 1, 5:
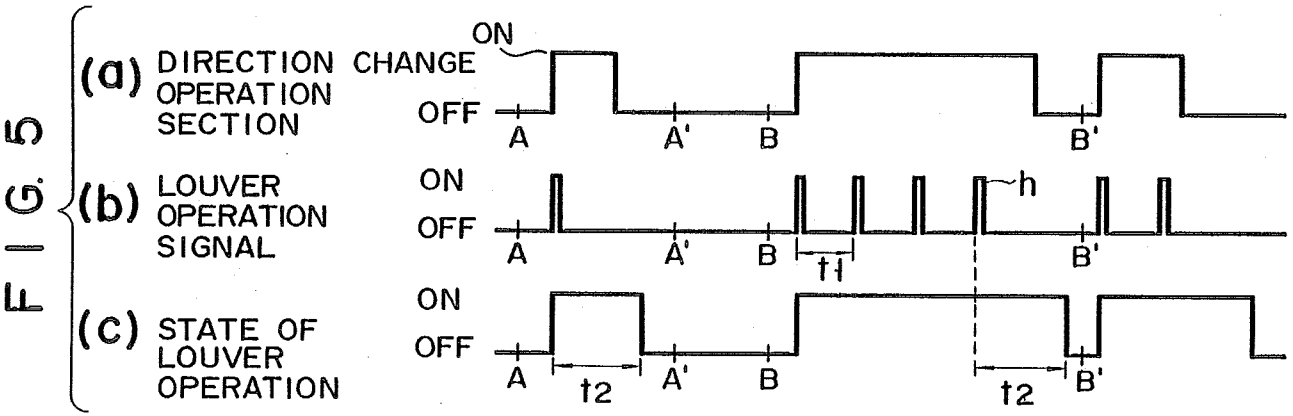
FIG. 5 is a timing chart for explaining the operation of the embodiment of this invention.

FIG. 5 is a timing chart for explaining the operation of the aforementioned embodiment. When the push button switch on direction change operation section 21 is rendered ON, a louver drive signal is immediately delivered, in an intermittent fashion, for every fixed time period t1, i.e., a setting time period of first timer means 34, until the switch is rendered OFF.

When the switch is rendered OFF, operation detection means 22 delivers a corresponding stop signal to intermittent signal generating means 23, causing the generation of the louver drive instruction signal to be stopped. In this case, first timer 24 is reset. If the depression period of the push button switch for direction change operation section 21 is shorter than the setting time t1 of the first timer means, then the next subsequent louver drive instruction signal is not generated as indicated by a period A—A' in FIG. 5, and louver 9 is driven by a time interval corresponding to the setting time t2 of second timer 34.

If the push button switch for air direction change is kept depressed, the louver drive instruction signal is delivered for every setting time t1 of first timer 24, as indicated by a time period B–B' in FIG. 5 to permit the louver to be driven in a continuous fashion. When the push button switch is released, the louver is stopped after a setting time t2 following a previous drive instruction signal (h in FIG. 5). According to this embodiment there occurs a time delay from the releasing of the push button switch until the driving operation of the louver is stopped. However, when the rotation of the louver motor is low enough, an error of the rotation angle of the louver slats due to a response delay can be restricted within an allowable range.

In air conditioner body 1, when receiving means 31 such as a photo-transistor receives a control signal from the remote controller, it sends a corresponding signal to signal analyzing means 32 where it is analyzed and checked. If that signal is found to be a louver drive instruction signal, the drive instruction signal is delivered to drive signal output means 33. Upon receipt of the drive instruction signal, drive signal output means 33 starts the operation of second timer means 34 and at the same time supplies a drive signal to louver motor 41, causing the louver slats to be driven. when the louver motor 41 and the louver slats are so driven, the louver slats ar swingably driven through linkage 42 to control the direction in which air is blown off. If as louver motor 41 use is made of, for example, a gear motor for a greater speed reduction, the louver slats can be swung from a horizontal to a vertical position, and hence to the horizontal position, on the order of, for example, about 10 seconds.

On the other hand, second timer means 34 starts a count operation upon receipt of a drive instruction signal and, after a lapse of the fixed time t2, supplies a time-out signal to drive signal output means 33. The drive signal is stopped from being output by that time-out signal. In this connection it is to be noted that when second timer means 34 again receives a drive instruction signal during the count operation it has its count contents reset, starting a count operation from the outset.

Thus the setting times t1 and t2 (400 millisecond and 500 millisecond, respectively,) of first and second timer means 24 are so determined as to be $t1 < t2$. During the ON operation of direction change operation section 21 the remote controller intermitently delivers a louver drive instruction signal as a control signal, causing the louver to be driven continuously.

If direction change operation section 21 is rendered OFF, the swing of the louver is stopped after the time period (t2) following a drive instruction signal produced immediately before the OFF operation.

This invention is not restricted to the abovementioned embodiment and can be modified as explained for example in FIGS. 6 to 9.

Figure 6:
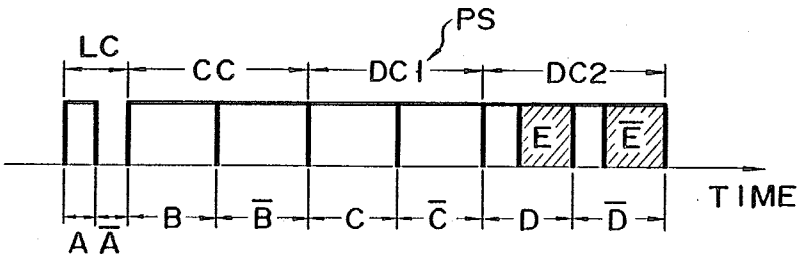
FIG. 6 is a timing chart showing a transmission waveform as used in another embodiment of this invention.

That is, a pulsating pattern signal PS which is initially coded in a format shown in FIG. 6 may be transmitted from the remote controller to air conditioner body 1.

The pattern signal PS is comprised of a leader code LC for judging the presence or absence of a signal transmission, custom code CC for specifying the air conditioner to be controlled and data codes DC1, DC2 for selecting the operation, temperature, amount of air, etc. and determining the setting values. A single operation of the push button switch for louver control permit the aforementioned pattern signal to be delivered once or a plurality of times.

The louver drive instruction signal is incorporated into data code DC2 as indicated by, for example, a crosshatched area. The contents of the respective codes of the pattern signal PS are represented by A, B, C and D and, for their identification, inverted signal codes $\overline{A}$, $\overline{B}$, $\overline{C}$ and $\overline{D}$ are utilized.

The aforementioned pattern signal PS transmitted from the remote controller is received by receiving means 31 of air conditioner body 1. Then, the signal PS is sent to signal analyzing means 32, which in turn supplies a drive instruction signal to drive signal output means in accordance with the pattern signal PS. The drive signal output means drives the louver motor to cause the louver slats to be swingably driven to control the direction in which air is blown off.

If a louver stop instruction is output by the depression of the push button switch, the drive signal output means stops the louver motor, thus stopping a swing of louver slats.

According to this invention the louver can continuously be driven by a single depression of the push button switch, thus obviating the necessity of continuously depressing the push button switch. This feature assures a reduction of a time required for the control signal to be transmitted from the remote controller, as well as a shorter life of the battery.

Figure 7:
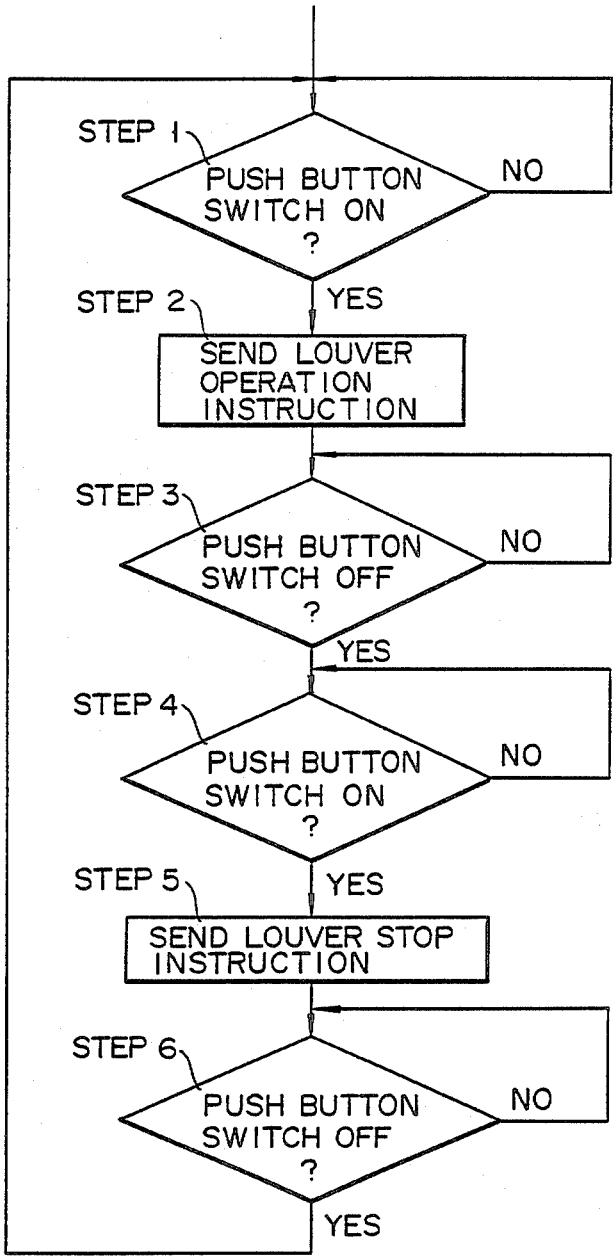
FIG. 7 is a flow chart for explaining the operation of a remote controller as used in the embodiment of FIG. 6.
Figure 8:
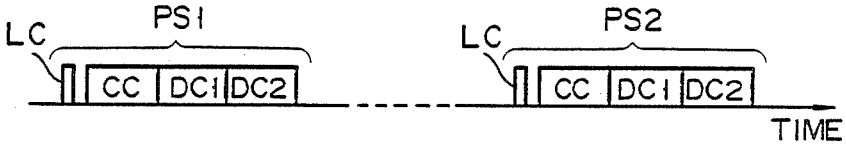
FIG. 8 is a timing chart showing a transmission waveform as used in another embodiment of this invention.

FIG. 7 is a flow chart showing a control signal transmission procedure through the remote controller.

At step 1 judgment is made as to whether or not the push button switch is rendered ON. If the answer is in the affirmative, then a louver drive instruction signal is transmitted at step 2. If the answer is in the negative, step 1 is repeated.

After step 2 judgment is made at step 3 as to whether or not the push button switch is rendered OFF. If the answer is in the negative, step 3 is repeated. If, on the other hand, the answer is in the affirmative, a louver stop instruction signal is transmitted at step 5. At step 6 judgment is made as to whether or not the push button switch is rendered OFF. If the answer is in the negative, step 6 is repeated. On the other hand, if the answer is in the affirmative, this step goes to step 1.

In the flow chart of FIG. 7, if a pattern signal PS1 is transmitted by a single depression of the push button switch, the louver is driven until the push button switch is again depressed. If a pattern signal PS2 is transmitted by that depression of the push button switch, the louver is stopped.

Figure 9:
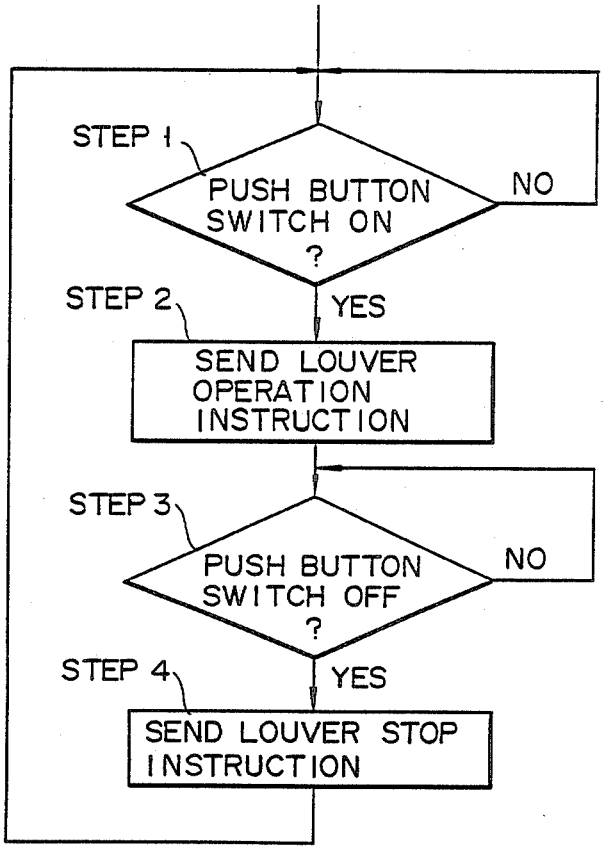
FIG. 9 is a flow chart for explaining the operation of a remote controller as used in the embodiment of FIG. 8.

A signal transmission procedure through the remote controller may be modified as indicated by a flow chart in FIG. 9.

That is, at step 1 judgment is made as to whether or not the push button switch is rendered ON.

If the answer is in the affirmative, a louver drive instruction signal is transmitted at step 2. If the answer is in the negative, then step 1 is again repeated. After execution of step 2, judgment is made at step 3 as to whether or not the push button switch is rendered ON. If the answer is in the negative, then step 3 is again repeated. If the answer is in the affirmative, then a louver stop instruction is transmitted at step 4. This step again goes to step 1.

That is, in the embodiment of FIG. 9 a louver drive instruction signal is transmitted with the push button switch in the ON state, while on the other hand a louver stop instruction signal is transmitted with the push button switch in the OFF state.

According to this embodiment it is possible to reduce a transmission time of the remote controller. It is also possible to prolong the life of the dry cell.

What is claimed is:

1. An air direction control apparatus for a louver at an air outlet of an air conditioner, comprising:

a remote control including a direction change operation section for issuring an air direction change operation instruction, operation detection means connected to said direction change operation section for detecting said air direction change instruction, first timer means which is initiated and stopped in reponse to the appearance and disappearance of said air direction change instruction for generating a first timer output every time a first period of time has elasped, and an intermittent signal generating means for intermittently geneating a remote control signal including a louver control signal in response to said timer output, and transmitting means for transmitting said intermittently generated remote control signal;

receiving means for receiving said remote control signal transmitted from said remote controller;

detection means for detecting the louver control signal included in said received remote control signal;

second timer means for measuring a second period of time longer than said first period of time;

drive signal output means for outputting a drive signal in response to said detected louver control signal for the time period meansured by said second timer means;

louver motor means driven by the drive signal outputted from said drive signal output means; and louver means driven by said louver motor to permit an air direction at an air outlet of the air conditioner to be contolled.

2. A control apparatus for controlling an operation of a louver at an air outlet of an air conditioner, comprising:

a remote controller for transmitting a single remote control signal which is generated in accordance with a single operation of a push button, said remote controller including means for generating a louver operation instruction and a louver stop instruction which are successively generted in reponse to successive operation of a push button;

receiving means for receiving said remote control signal transmitted from said remote controller;

detection means for detecting the louver operation instruction and the louver stop instruction included in said receiver remote control signal;

drive signal output means for outputting a drive signal in response to said detected louver operation signal;

louver motor means driven by the drive signal;

louver means driven by said louver motor means to direct air at a direction from an air outlet of the air conditioner; and stopping means for stoping the louver motor means thereby stoping the louver means in reponse to the detected louver stop instruction.

* * * * *